United States Patent [19]

Babson et al.

[11] Patent Number: 4,546,716

[45] Date of Patent: Oct. 15, 1985

[54] DOUBLE OVERLOCK SEAMER

[75] Inventors: Edward Babson, Ipswich; Michael R. Porter, Topsfield; Robert E. Porter, Hamilton, all of Mass.

[73] Assignee: Porter Sewing Machines, Inc., Beverly, Mass.

[21] Appl. No.: 635,714

[22] Filed: Jul. 30, 1984

[51] Int. Cl.[4] ..... D05B 1/08; D05B 1/20

[52] U.S. Cl. ..... 112/162; 112/163; 112/147; 112/153; 112/235; 112/239; 112/276; 112/260; 112/311; 112/272

[58] Field of Search ..... 112/163, 164, 167, 162, 112/177, 260, 153, 147, 288, 276, 311, 239, 235, 272

[56] References Cited

U.S. PATENT DOCUMENTS

| | | | |
|---|---|---|---|
| 2,483,138 | 9/1949 | Helmer | 112/272 |
| 2,973,731 | 3/1961 | Sigoda | 112/162 |
| 3,126,850 | 3/1964 | Sigoda | 112/162 |
| 3,245,369 | 4/1966 | Myska | 112/239 X |
| 3,246,620 | 4/1966 | Sigoda et al. | 112/162 |
| 3,363,594 | 1/1968 | Kosrow | 112/272 X |
| 3,530,809 | 9/1970 | Porter | 112/311 |
| 3,541,982 | 11/1970 | Manforio | 112/239 X |
| 3,754,522 | 8/1973 | Miller et al. | 112/272 |
| 3,995,571 | 12/1976 | Porter | 112/311 |
| 4,166,422 | 9/1979 | Porter | 112/311 |
| 4,449,464 | 5/1984 | Porter | 112/311 |

OTHER PUBLICATIONS

"UR 10-021 UR 10-041 Elements on Request" Brochure from Rockwell-Rimoldi S.p.A..

"Man-Sew" Twin Overedger Brochure.

*Primary Examiner*—H. Hampton Hunter

*Attorney, Agent, or Firm*—Wolf, Greenfield & Sacks

[57] ABSTRACT

In a sewing machine for performing twin overedging and seaming in one high-speed operation, specially designed top and bottom variable feed dogs pull the two plies through a three needle stitching area with improved, simplified elements for diverting one ply edge while the other is being overcast. The upright overcast edge of the top ply passes through a tunnel formed through the top feed dog. A guide wall attached to the throat plate guides the top edge away from the bottom overedging station. A guard wall can be attached to the presser foot to keep the turned-up top edge away from the seaming needle. A fiber optic/pneumatic system controls automatic stop, presser foot/top feed retraction and between-work thread cutter functions. Alternative front edge guides facilitate feeding the two plies in registration.

24 Claims, 27 Drawing Figures

DOUBLE OVERLOCK SEAMER

BACKGROUND OF THE INVENTION

The invention relates generally to sewing machines and attachments for seaming and overedging two fabric plies in the same operation.

Each leg of a pair of pants is normally formed of two elongated plies of material joined at their edges by two parallel longitudinal seams to form a tubular construction. Pants fabric when cut leaves free filaments of thread along the cut edge. For the comfort of the wearer and to prevent fraying, both longitudinal edges of each ply are usually overcast in an overedging machine. Then, both plies are brought together, one superposed on the other. An adjoining seam spaced inwardly from the overcast edges is sewn, usually with a chain stitch. The free edges of the plies beyond the join seam stitch are then folded back in opposite directions against the inside of the fabric to form what is known in the trade as a "bust open" seam. Two overedging and one seam stitching operation are required for each seam.

Due to the parallel juxtaposed stitches required for these three operations, attempts have been made in the past to combine the three stitching operations into a single machine so that the overedging and join seam stitching can be completed in one pass. U.S. Pat. No. 3,246,620 to Sigoda describes a set of attachments for a standard single needle lock stitch sewing machine which is modified by adding two overedging needles which cooperate with loopers to produce two thread overedging stitches on the edges of both plies in sequence. A needle plate is provided with shaped elements which cooperate with a presser foot of complex geometry to temporarily fold down the lower ply edge while the top ply edge is being overcast and then rotate the angle of the ply edges 90° so that the top ply is standing up while the lower ply is being overcast. The join seam stitch is made simultaneously with the overedging of the lower ply. The two plies are advanced through the stitching stations by a conventional reciprocating lower feed dog arrangement having a plurality of serrated runners which contact the lower side of the bottom ply to advance the material.

Numerous problems associated with actual devices along the foregoing lines have frustrated their commercial acceptance by clothing manufacturers. The speed of the single operation, overedging or join seam stitching, cannot be maintained by prior machines because of the inadequacy of the feed to maintain registration of the plies and extreme complexity of the needle plate and presser foot elements for diverting one of plies while the other is being overedged. The complex presser foot of the prior art obscures the operator's view of the stitching area. Consequently, the prior art machinery taking this approach was unsuitable for mass production of pants, and pants makers have gone back to pants seaming in three separate high speed operations.

The primary objective of the present invention is to perfect the double overlock seamer of the prior art for performing all three stitching operations simultaneously at speeds and with ease of operation approaching that of the single operation.

SUMMARY OF THE INVENTION

The present invention achieves a dramatic increase in the sewing speed and reliability of a double overlock seaming machine by employing top and bottom coacting feed dogs to pull the two plies through the stitching area and by simplifying the geometry of the elements which divert one ply while the other is being overedged. In the preferred embodiment, all of the diverting elements are attached to the throat plate. A conventional presser foot, preferably of the articulated compensating type, may be employed without any special ply diverting elements on the presser foot itself. However, it is preferred to mount a top edge guard wall on the foot to insure that the top edge is not sewn into the seam. The simplified presser foot increases the visibility of the stitching area. In the preferred embodiment, the top ply is overedged first, while the bottom ply edge is retracted. Next, the top ply is turned up by the throat plate assembly while the bottom ply is overedged and the join seam stitch is made. The standing overcast edge of the top ply passes through a notch or tunnel formed through the top feed dog. The feed dog tunnel not only permits close placement of the top feed dog to the last stitching station, but also assists in keeping the top ply edge upright. Because a wall is formed in the throat plate assembly between the upright top ply and the stitching area for overedging the bottom ply, the possibility of binding the two ply edges together in the bottom ply overedging operation is practically eliminated.

In the preferred embodiment, a light sensor automatically stops the sewing operation when the trailing end of the two plies passes by. A double action treadle is employed. Heeling down on the treadle causes the presser foot and top feed dog to lift simultaneously unless the light sensor indicates that material is present in the stitching area. An automatic thread cutter is attached just behind the top feed dog to cut the threads between each pant leg when a second sensor senses the passage of the trailing edge of the work.

DESCRIPTION OF THE PREFERRED EMBODIMENTS

Figure 1:
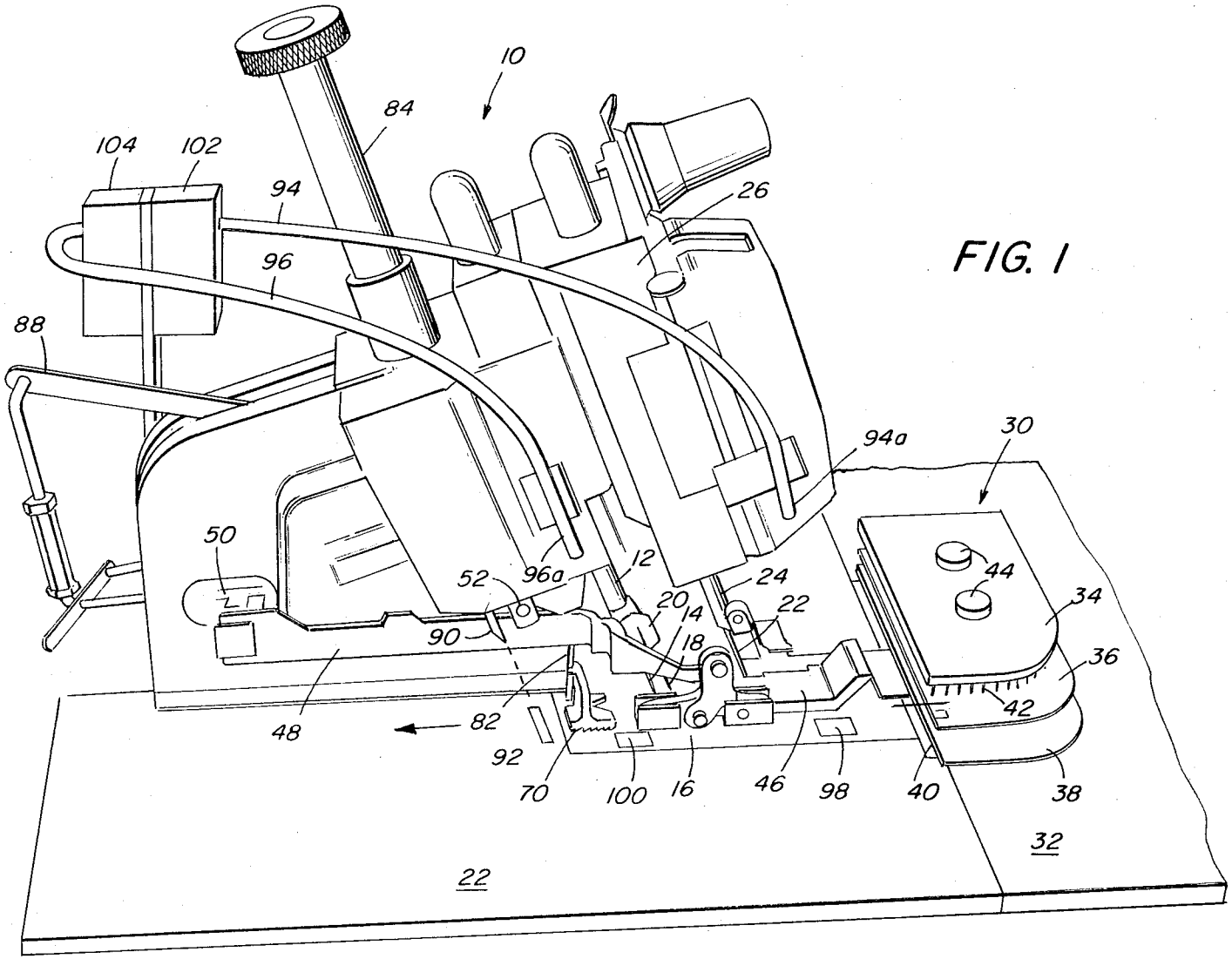
FIG. 1 is a side perspective view of the double overlock seamer mounted on a sewing table with a front guide.
Figure 2:
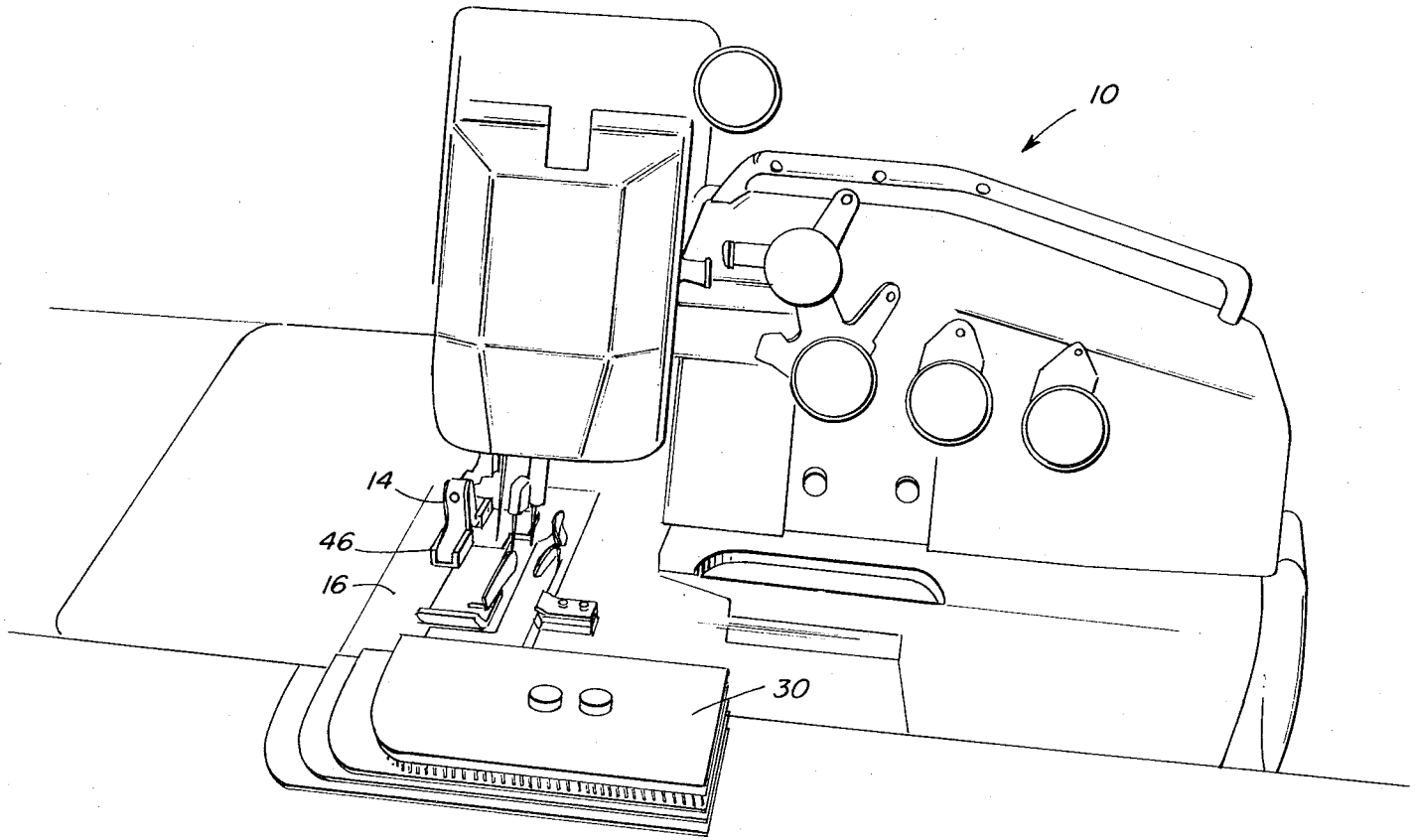
FIG. 2 is a front perspective view of the seamer of FIG. 1 from the operator's side.

A double overlock seamer constructed according to the principles of the invention is shown from two angles in FIGS. 1 and 2. The apparatus is specifically designed to make so-called bust open seams for pants and skirts, for example, in which the free edges of the plies beyond the join seam stitch are folded back in opposite directions against the inside of the fabric. In addition, to the join seam stitch, the machine simultaneously overcasts the edges of both plies to secure the free filaments along the cut edge.

In preparation for seaming, the material is cut into elongated raw panels. Two panels, one laid on top of the other, are united to form the sleeve-like pant leg, for example, by joining the respective pairs of elongated edges with bust open seams. In the present invention, one complete seam is made in one pass of the material; the other seam is made in a second pass through the machine.

As used herein, the terms "panel" and "ply" refer to a single sheet of material, fabric or cloth. The terms "overlock", "overcast", and "overedge" are used synonymously to refer to the stitching operation for binding or securing the raw cut edge of a given ply or panel.

As in many custom applications of this kind, the machinery is devised by modifying a carefully selected commercially available standard sewing machine. In the present case, the Wilcox-Gibbs overedge safety stitch machine 10 (FIG. 1) was chosen as the base on which to build the necessary additions, modifications and accessories. Because the Wilcox-Gibbs machine is a commercially available sewing machine, details of its inner mechanisms will not be described here except insofar as they must be presented in order to understand the modifications and additional components.

The base machine 10 offers one reciprocating needlebar 12 on an inclined axis. Needle 14 carried by needle bar 12 penetrates the plane of a throat plate 16 mounted flush with the top surface of the sewing table 22. Needle bar 12 also carries a join seam needle 18 which is coupled in parallel to the original needle 14 by a yoke 20. Needle 18 is mounted slightly forward of needle 14 and offset laterally away from the base machine 10, i.e., transverse to the direction of the work indicated by the arrows in FIG. 1 away from the edge so that needle 18 pierces the plies farther away from the edges to form the uniting seam. The standard machine is equipped with serrated feed dogs (not shown) beneath the stitching area. As usual, the feed dogs protrude through corresponding slots in the standard throat plate. The standard machine comes with loopers beneath the throat plate 16 for forming a two thread chain stitch in cooperation with needles 14 and 18. For overedging operations, a reciprocating spreader takes the thread associated with needle 14 laterally over the raw edge of the ply. Needle 14 and its cooperating looper and spreader, along with needle 18 and its looper, are synchronized by a conventional drive mechanism. Finally, the base machine is usually equipped with a presser foot which urges the work against the feed dogs to advance it through the stitching area of the throat plate 16.

To summarize the modifications to the base machine in the presently preferred embodiment, a third needle is added to do the overedging of the other ply along with its cooperating looper and another spreader; the throat plate and presser foot are redesigned; the lower feed dog is modified; a special top feed dog is added; and a front feed guide is added to separate and align the plies. In addition, an automatic thread chopper is added along with fiber optic monitors to control the chopper, automatic end and the lifting of the top feed dog and presser foot via a specially designed pneumatic system for ease of operation.

The standard overlock machine is modified to do two overedging operations at once along with a single chain stitch to form the join seam. The third needle 22 is carried by a second needle bar 24 reciprocated by means of machinery which essentially duplicates the drive for needle bar 12. Both needle bars 12 and 24 are driven off of the same eccentrics in the base machine 10. The extra mechanism necessary to drive the second needle bar 24 is contained within an added housing 26. The needle bar 24 is mounted in parallel to and approximately aligned in front of needle bar 12 as viewed from the operator position in FIG. 2. To equip the machine for the second overedging operation, an additional looper and a spreader (not shown) are mounted beneath the stitching area to cooperate with needle 22 in forming an overedge stitch on the other ply. The loopers and spreaders (not shown) are themselves conventional and are driven by the same mechanical linkage which drives the looper and spreader used for the single needle 14 overedging operation. The loopers and spreaders are all driven off of the same eccentrics in the base machine 10.

Aligned needles 14 and 22 and seam stitch needle 18 to one side are all driven synchronously. Respective threads are supplied to each of the three needles and the loopers via conventional thread guides and tensioners from a multi-spool thread stand (not shown).

A front guide 30 is mounted on a tabletop 32 adjoining the sewing table 22. The guide 30 is commercially available from Rockwell-Rimaldi S.p.A. The purpose of the guide 30, situated in front of the throat plate 16, is to automatically align the panel edges and separate the superposed plies. The guide 30 is comprised of an upper frame member 34, a curved top plate 36 with an upwardly flared rounded edge, central plate 38 and base 40 attached to the table 32. A fence-like margin of spaced vertical rods 42 form a lateral fabric stop which determines the sewing margin. The rods 42 extend through corresponding apertures in the plates 36 and 38. The spacing between top plate 36 and central plate 38 and between central plate 38 and base 40 is variable by means of adjustment knobs 44. A pneumatic cylinder is used in the present embodiment to change between two predetermined spacings for thin and bulky feedstock. In use, the top ply passes between the top plate 36 and central plate 38, while the bottom ply passes between the central plate 38 and base 40. The ply edges lie in registry against the fabric stop rods 42.

As the work approaches the stitching area, both plies are sandwiched beneath the throat plate 16 and an articulated compensating presser foot 46 which urges the plies against a reciprocating differential lower feed dog mechanism which extends through the throat plate alternately engaging and disengaging the lower surface of the bottom ply to advance the work through the stitching area. The compensating presser foot 46 is connected to a swing arm 48 connected to a pivoting shaft 50 for raising the pressure foot to receive new work. The arm 48 can also be pivoted laterally away from the stitching area. The swing arm 48 is urged downwardly by spring loaded fork 52.

Figure 9A:
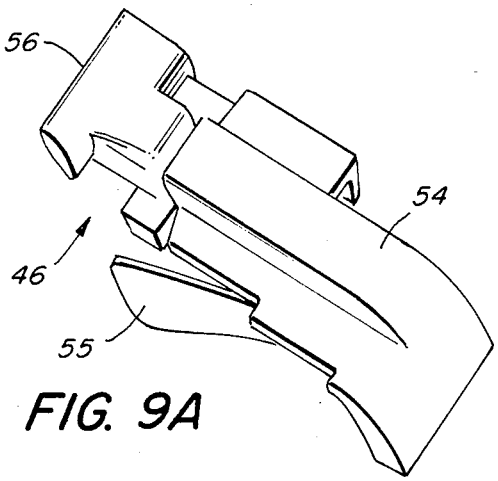
FIGS. 9A and 9B are top and bottom perspective views, respectively of the presser foot on the seamer of FIGS. 1 and 2.
Figure 9B:
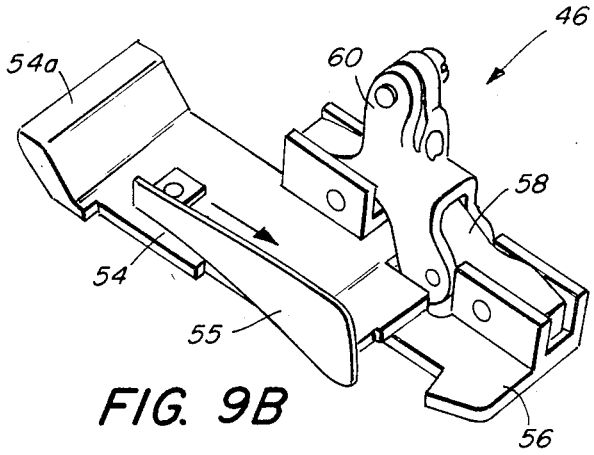

The compensating presser foot 46 is shown in detail in FIGS. 9A and 9B. The foot 46 is divided into two secitons. A forward foot member 54 has an upwardly flared front end 54*a* where the work, moving in the direction of the arrow in FIG. 9A, first encounters the pressure foot. A trailing rear foot member 56 completes the lower surface of the pressure foot. Members 54 and 56 are pivotally connected to opposite ends of yoke 58. At an intermediate point, yoke 58 is pivotally connected to link 60 which in turn is connected to the swing arm 48 (FIG. 1). An upstanding seam guard wall 55 is attached to the forward foot member 54 to keep the top ply edge away from the seam needle 18. (See FIG. 14.) The near end of the wall 55 should terminate just about even with needle 18 to allow the foot 46 to swing clear.

Figure 11A:
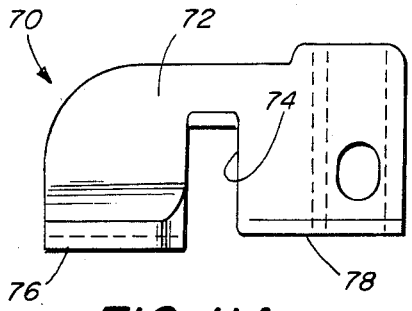
FIGS. 11A, 11B and 11C are front, side and top views, respectively, of the top feed dog of the seamer of FIGS. 1 and 2.
Figure 11B:
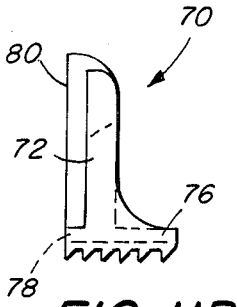
Figure 11C:
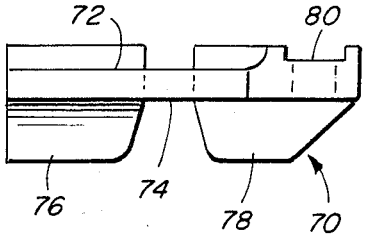
Figure 13:
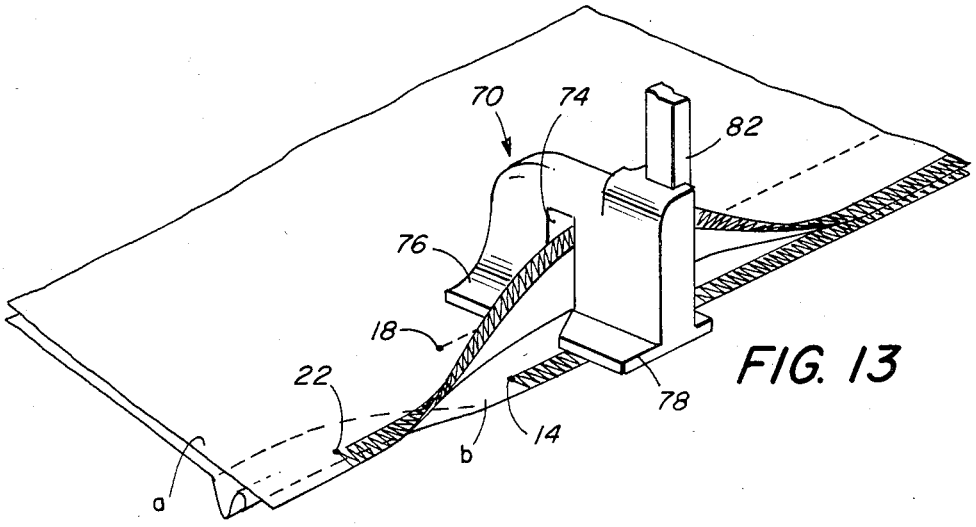
FIG. 13 is a schematic perspective representation of the double overlock seamer operation showing the top feed dog.

As shown in FIG. 1, behind the presser foot 46, a top feed dog 70 is located to cooperate with a lower feed dog. As shown in FIGS. 11A, 11B, 11C and 13, feed dog 70 includes a vertical plate 72, mounted transversely to the stitch direction, divided into two integral sections by a vertical notch or tunnel 74. The left hand section of the plate 72 as viewed in FIG. 11A carries an integral horizontal lower base 76 with fabric gripping serrations on the bottom. The right-hand section is connected to a parallel base 78 from which the serrations have been removed. At the entry to the tunnel 74, the bases 76 and 78 are slightly flared as shown in FIG. 11C. Above the non-serrated base 78, the wall 72 includes a mounting keyway or bracket 80 for connection to the top feed dog arm 82 (FIGS. 1 and 13). Feed dog 70 reciprocates axially in the direction of motion of the work to execute a feed stroke with the cooperating bottom feed dog (not shown) extending through a slot in the throat plate 16. At the end of the top feed dog excursion, feed dog 70 lifts slightly on the return stroke. The action of the feed dog 70 can be mechanized as shown in U.S. Pat. No. 4,166,422 to Robert E. Porter. Alternatively, the top feed dog and presser foot can be mechanized, as shown in U.S. Pat. No. 4,449,464 to Robert E. Porter, as a walking foot feed in which the presser foot moves up and down out of phase with the top feed. Thus, the presser foot periodically lifts off the work while the top and lower feed dogs grab and advance the work. Still another refinement is to use a variable top feed in which the horizontal forward motion of the top feed dog can be sped up or slowed down slightly relative to the lower feed dog to overfeed or underfeed the top ply to prevent the plies from getting out of registration. The top feed arm 82 is pivotally connected to the reciprocating linkage for the lower feed dog. In addition, the top feed arm 82 is spring biased against the work at a pressure level adjustable by means of spring loaded cylinder 84. Pneumatically actuated linkage 88 is designed to lift the presser foot and top feed dog to insert new work.

A chopper blade 90 is stationed just behind the top feed dog 70. Blade 90 is mounted to the housing of the base machine 10 and actuated by a pneumatic cylinder via a treadle. When actuated, the blade travels through the plane of the top of the table 22 through slot 92 to cut thread between work pieces.

A fiber optic sensor system is used to automatically stop the sewing machine and to disable the chopper and the raising of the presser foot and the top feed functions. Two fiber optic cables 94 and 96 transmit and receive reflected light from strategically located pieces of reflective tape 98 and 100 mounted on the throat plate 16 as shown in FIG. 1. Each fiber optic cable is connected to a respective "electric eye" signal device 102, 104 providing respective electrical outputs indicative of the presence or absence of reflected light. When the tape 98 or 100 is covered by the work, the light reflection is interrupted. The function of the fiber optic system is described below in connection with FIG. 12.

Throat Plate Design and Function

Figure 3A:
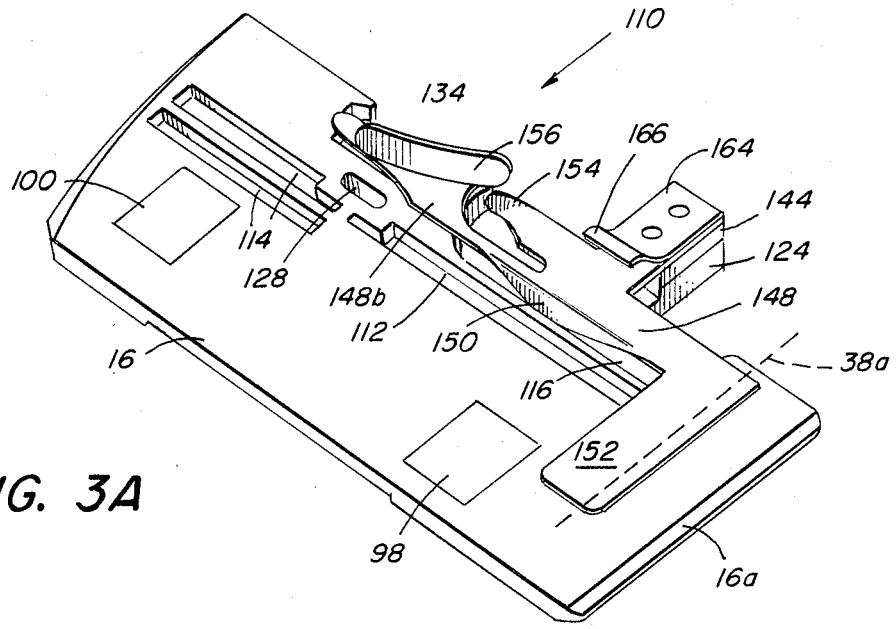
FIG. 3A is a top perspective view of the throat plate assembly of the seamer of FIGS. 1 and 2.
Figure 3B:
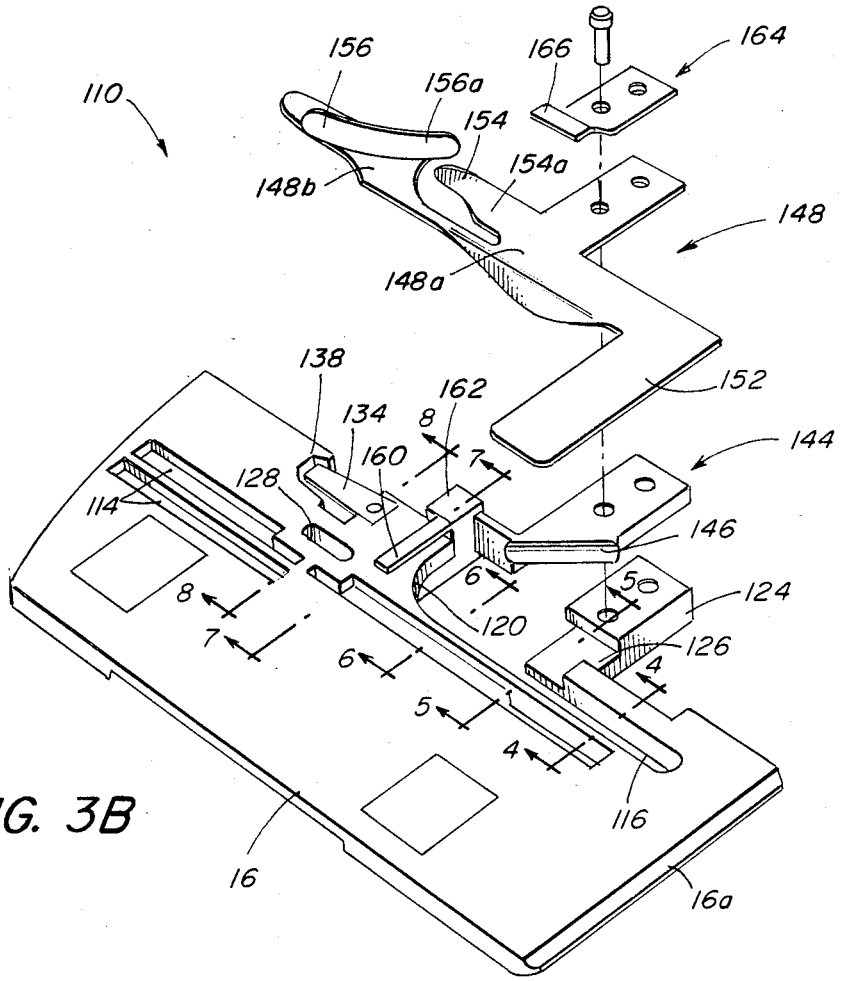
FIG. 3B is an exploded perspective view of the throat plate assembly of FIG. 3A.

The throat plate assembly 110 of FIG. 3A carries separate stitch tongues for the top and bottom plies and all of the ply diverting elements necessary for sequential overcasting of the edges of the top and bottom plies. As shown in FIG. 3B, the assembly 110 includes a specially modified throat plate 16 to which a plurality of guide elements are affixed. The plate 16 itself is shown in detail in FIG. 10. The plate has axially aligned elongated front and rear feed dog slots 112 and 114 through which the lower feed dogs (not shown) intermittently protrude during a synchronized feed stroke. The throat plate 16 is designed to accommodate three stitching locations identified by the needles 14, 18 and 22 which penetrate the plane of the throat plate 16 at the locations indicated in FIG. 10. Near the front end 16*a* of the throat plate, a channel 116 with a U-shaped cross-section is formed parallel to and just to the right of the forward feed dog slot 112, as viewed in FIG. 10. Channel 116 opens into a cutout area 118 having an arcuate sloping back wall 120. Just before cutout area 118, a side arm 122 extends transversely to the right as viewed in FIG. 10 to provide a mounting boss 124 to which other guide elements are connected as shown in FIG. 3B. Between the boss 124 and channel 116, area 126 on the arm 122 is recessed below the plane of the upper surface of the throat plate 16. After cutout 118 where the top ply is overcast, needle hole 128 is formed approximately in alignment with channel 116. Penetrating both plies, the join seam needle 18 passes through needle hole 128. To the right of and just beyond the join seam stitching area, a recessed mounting surface 130 with a threaded aperture 132 receives the base of the tapered bottom ply stitch tongue 134 (FIG. 3A) which extends parallel to the surface of the throat plate 16 across the notched area 136 which accommodates the bottom overcasting needles. A portion 138 of the top surface of the throat plate 16 is cut away at an angle to leave the tip of the stitch tongue 134 free. A similar larger undercut 140 is made on the underside of the throat plate 116 at notch 136 to accommodate the looper which cooperates with the bottom overcasting needle 14.

Ply diverting and guide elements are connected to the throat plate 16 at the boss 124 as shown in FIGS. 3A and 3B. Curl guide 144 is connected directly to the boss 124 as shown in FIG. 3B. Curl guide 144 includes an elongated cylindrical guide wall 146 angled as shown in FIG. 3B. On top of the curl guide 144, a cantilevered top ply guide plate 148 includes an elongated body portion 148*a* with a curved depending flange 150 which extends into the channel 116 in the throat plate. At the forward end of the top guide body portion 148, a front flap 152 extends leftward to divide the plies. The top ply goes over flap 152 and the bottom ply goes between the flap 152 and the front end 16*a* of the throat plate. At the other end of the body portion 148*a* of the top guide plate 148, a tapered twisted elongated top ply stitch tongue 154 is formed. The base portion 154*a* of the tongue, where it meets the body 148*a* of the top guide, starts out in the same horizontal plane. However, the tongue is twisted continuously towards the tip 154*b* which lies approximately in a vertical plane. The rear end portion 148*b* of the top guide plate remains in the same horizontal plane as portion 148*a*. A curved vertical guide wall 156 is affixed by means of a brazed joint to the rear portion 148*b*. The front end 156*a* of the guide wall terminates just to the right of the twisted stitch tongue tip 154*b* and is spaced slightly therefrom to allow removal of the overcast top ply from the stitch tongue and leftward diversion of the top ply edge by the guide wall 156. The rear end 148*b* of the top guide plate 148 carrying the guide wall 156 is supported by cantilevered flange 160 extending leftward above the arcuate wall 120 from an L-shaped mounting bracket 162 bolted to the underside of the throat plate 16.

Finally, on top of the top guide plate 148, a top edge guide 164 is mounted with a top ply edge trapping flange 166.

As shown in FIG. 3B, guide elements 144, 148 and 164 are mounted on top of each other and bolted to the mounting boss 124 at the right side of the throat plate 16. The completed throat plate assembly 110 appears as shown in FIG. 3A.

Figure 4:
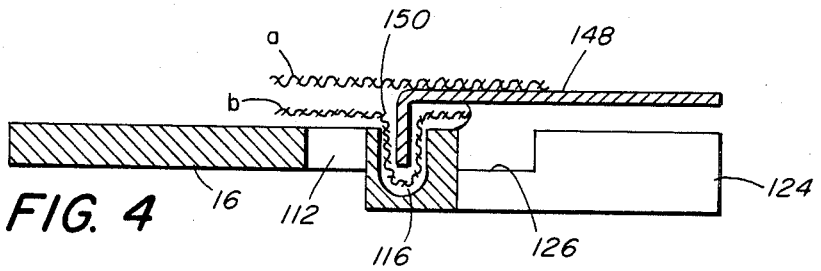
FIGS. 4–8 are sectional views of the throat plate assembly of FIG. 3A taken along the corresponding lines indicated in FIG. 3B.
Figure 5:
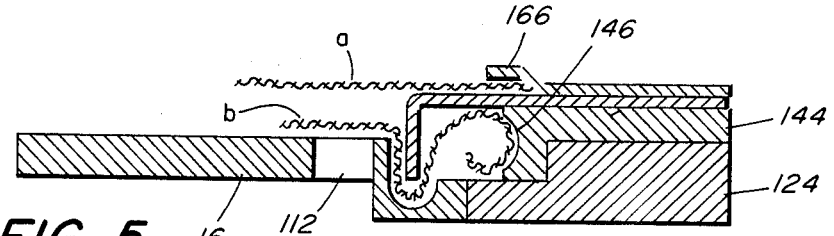

In operation, the threads are inserted, tensioners adjusted and cloth guide 30 (FIG. 1) is juxtaposed in front of the front end of the throat plate 16A so that the adjacent edge 38*a* of the central plate 38 of the guide 30 contacts and overlaps the front flap 152 of the top guide 148 as indicated in FIG. 3A. Thus, the top guide 148 acts as an extension of the central plate 38 of the front guide 30 in FIG. 1 so that the top ply passes over the top guide 148 while the bottom ply passes beneath the front flap 152 of the top guide 148. As the bottom ply passes under and beyond front flap 152, it encounters the inclined edge of the depending flange 150 which extends into the throat plate channel 116. The flange 150 pokes a loop of the bottom ply material into the channel 116*b* as shown in FIG. 4. The slightly retracted free edge of the lower ply b next encounters the curl guide 146 which forces a reverse loop in the lower ply b as shown in FIG. 5. Because of the angle of the curl guide 146, the two loops or pleats in the edge of the lower ply b compress like an accordion so that the lower ply is retracted out of the way of the overcasting operation for the fully extended upper ply a. Note that the free end of the upper ply a extends all the way to the edge guide 166.

Figure 6:
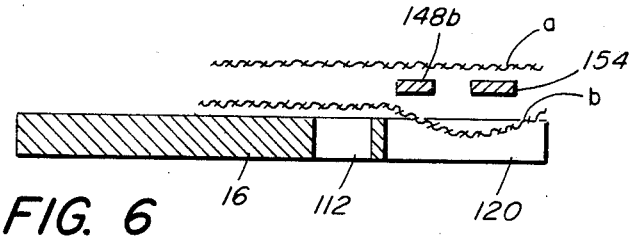

The top ply overcasting needle 22 in cooperation with its corresponding looper and spreader binds the free edge of the top ply a to the curved stitched tongue 154 carried on the top guide plate 148 while the lower ply b is tucked out of the way. Bound onto the stitch tongue 154, the upper ply a is carried by the twisted tongue to the upright tip 154*b* (FIG. 3B). Meanwhile, as shown in FIG. 6, the edge of ply b is unfolded and allowed to extend fully in preparation for overcasting.

Figure 7:
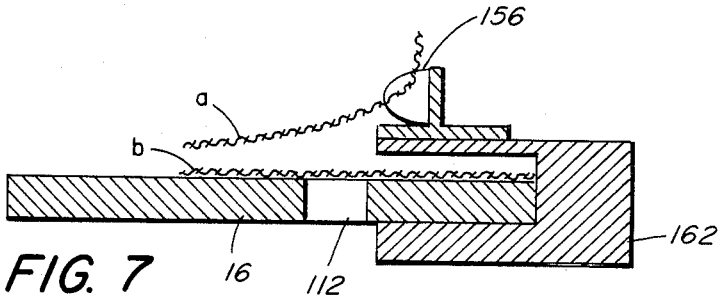
Figure 8:
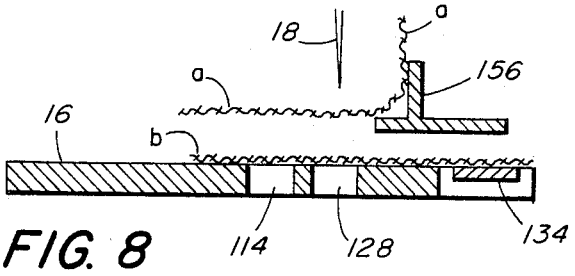
Figure 14:
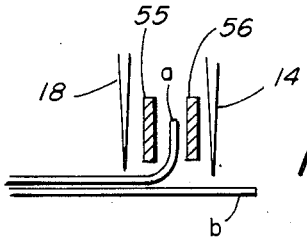
FIG. 14 is a schematic representation of the simultaneous lower ply over-edge and join seam operation viewed from the front.

The overcast top ply edge b slips free of the end of the twisted stitch tongue 154 and is diverted upwards and to the left by the guide wall 156 as shown in FIGS. 7 and 8. With the top ply turned up as shown in FIGS. 8 and 14, the join seam needle 18 pierces both plies and the bottom edge overcasting needle 14 with its cooperating looper and spreader binds the free edge of the bottom ply b to the bottom stitch tongue 134. Because of the interrelationship between the twisted stitch tongue 154, horizontal end portion 148*b* of the top guide plate and the curved wall 156, it is impossible for the top ply to be caught up in the overcasting of the bottom ply edge. Moreover, the provision of guard wall 55 on the presser foot 46 keeps the top ply edge away from the seaming needle 18 as shown in FIG. 14.

Figure 10:
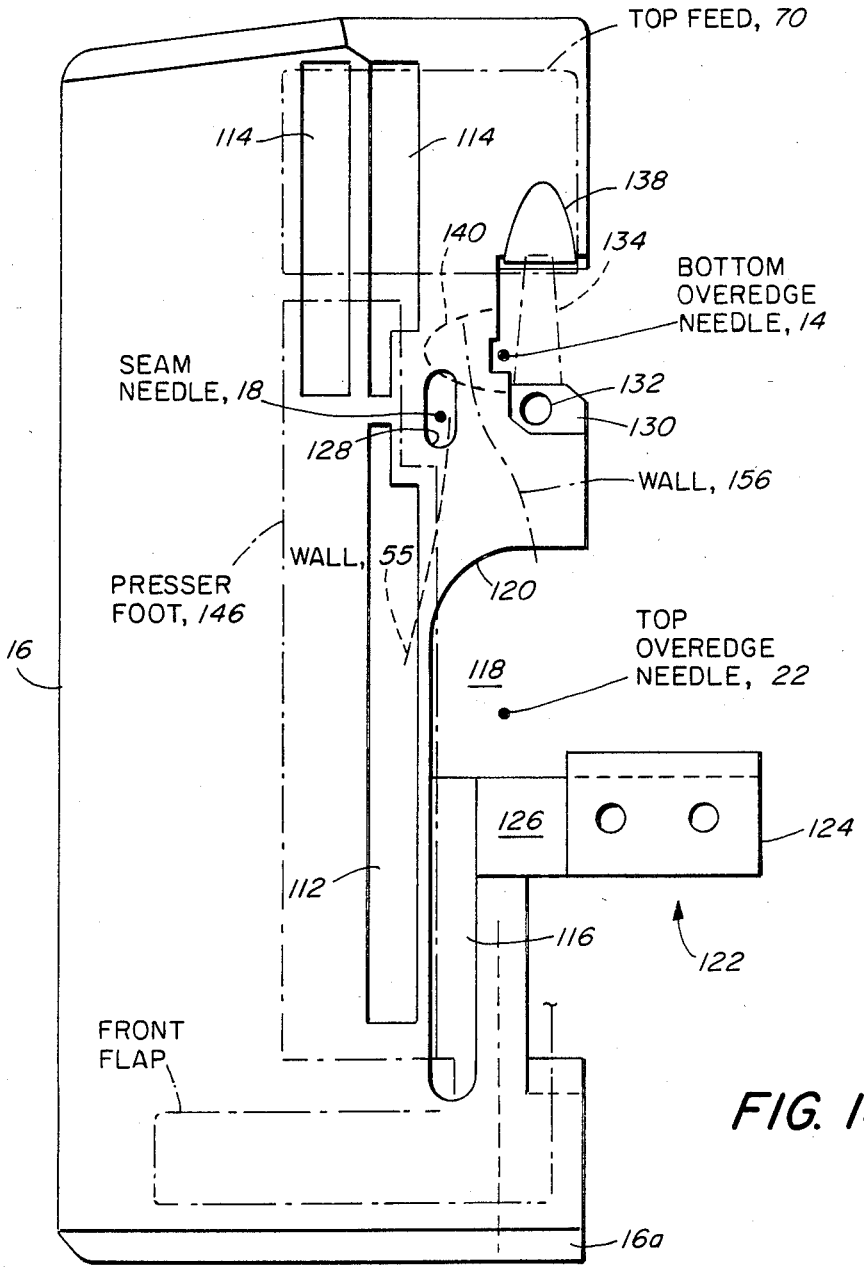
FIG. 10 is a plan view of the throat plate without attachments.

Immediately behind the guide wall 156, top feed 70, as shown in FIGS. 10 and 13, receives the upstanding overcast top ply edge through tunnel 74. As shown in FIG. 13, the right-hand shoe 78 of top feed 70 has no serrations and does not advance the single bottom ply b. Preferably, there are no lower feed dogs beneath shoe 78. On the other hand, the left shoe 76 is serrated and cooperates with the lower feed dogs extending through the slots 114 to advance both plies simultaneously. It was found that feeding the single ply created problems since the single ply could get out of synchronization with the adjacent double ply causing bunching. Thus, shoe 78 is a dummy feed dog which serves only to keep the lower ply flat and to form the other side of the tunnel 74 to hold the upstanding edge of the upper ply.

Fiber Optic Control System

Figure 12:
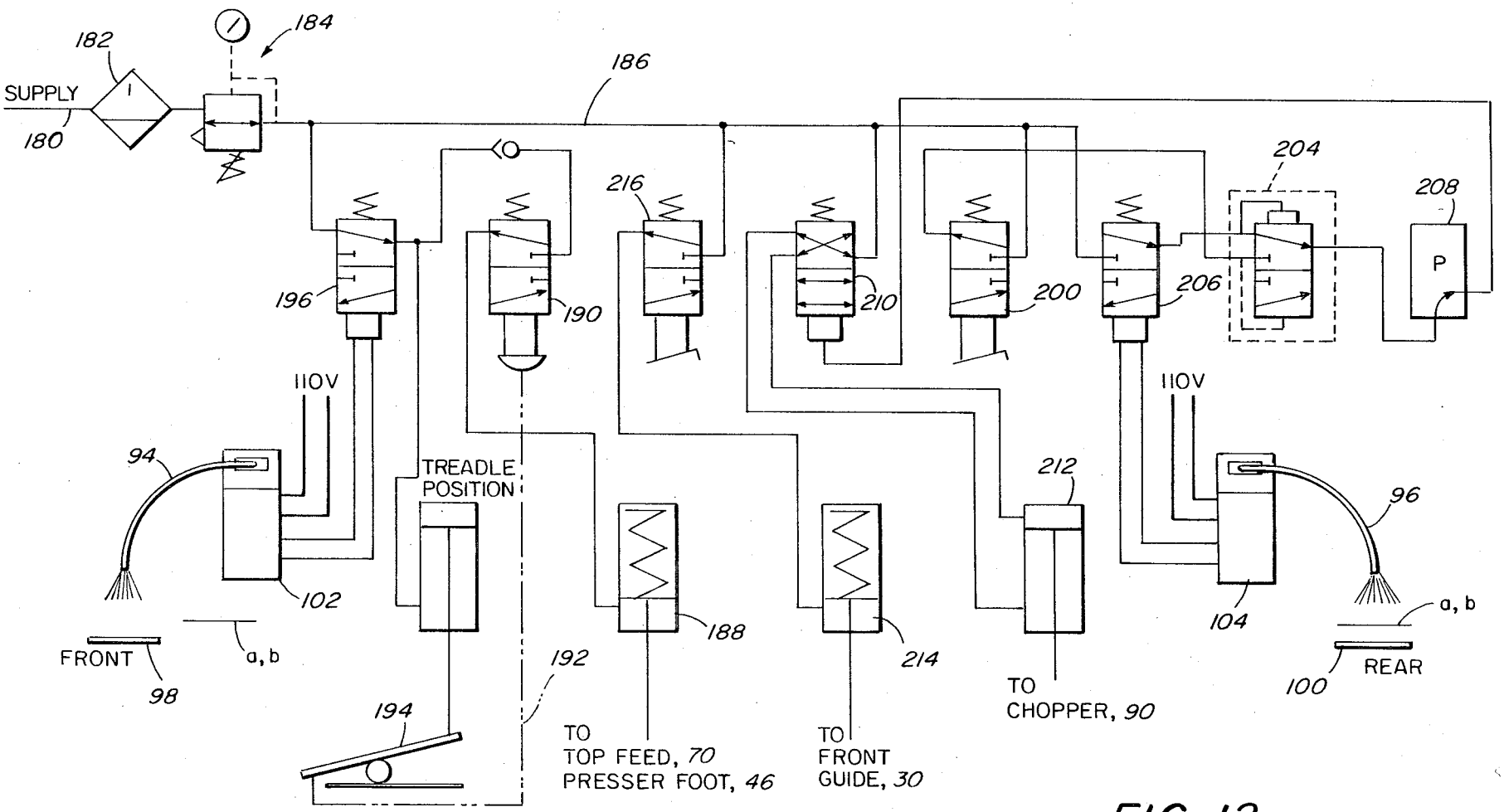
FIG. 12 is a pneumatic control diagram for the chopper, presser foot and top feed dog of the seamer of FIG. 1.

As shown in FIG. 12, a pneumatic supply line 180 provides a source of pressurized air via moisture trap 182 and an adjustable pressure regulator 184. The dry regulated pressure output on line 186 is made available to a plurality of pneumatic three-way valves which operate like relays. The top feed dog 70 and presser foot 46 are lifted by means of the same spring biased pneumatic piston 188. The circuit for actuating piston 188 includes mechanically actuated three-way valve 190. The mechanical actuator is connected via linkage 192 to the rear of the main foot treadle 194. Pressing forward on treadle 194 increases the speed of the sewing machine. Heeling up on the treadle actuates relay 190 to complete the air circuit to supply pressurzing air to the lift piston 188. The air circuit, however, is interrupted by an electrically actuated (solenoid) three-way valve 196 which is controlled by the output of the light detector 102 which monitors reflection from the front reflective tape 98 via fiber optic cable 94. In addition, the air output of valve 196 pressurizes the treadle piston to retract the treadle 194 to the OFF position as shown. When material is fed onto the throat plate covering the front tape 98, valve 196 opens the air circuit disabling the treadle piston, thus enabling the treadle 194 to control the sewing machine. Since no air flows out of valve 196, no air flows through valve 190. Thus, piston 188 is not actuated. As a result, the top feed dog and presser foot remain in the lowered operating position. When the end of the material passes by the stitching area uncovering the front tape 98, the situation reverses. Specifically, valve 196 closes, supplying air to actuate the treadle piston. At the same time, valve 190 is supplied with air so that when the treadle 194 is heeled, the piston 188 is actuated to lift the top feed dog 70 and presser foot 46 to enable insertion of new work.

The thread chopper 90 is triggered by a mechanically actuated three-way valve 200 via a dedicated treadle 202. When the treadle 202 is pressed, the output of valve 200 is connected to the supply line 186 to supply one input of shuttle valve 204. The other input to shuttle valve 204 is connected to the supply line 186 via an electrically actuated three-way valve 206 controlled by the output of light detector 104 responsive to light reflection from the rear tape 100 via fiber optic cable 96 (FIG. 1). The output of the shuttle valve 204 energizes a pulse valve 208 whose output is fed to a pneumatic controlled three-way valve 210 having a pair of complementary outputs connected to the respective ends of double acting cylinder 212. The piston of cylinder 212 is connected to the chopper 90 (FIG. 1).

Thus, the chopper can be actuated either manually by depressing the treadle 202 or automatically by electric eye. When the rear tape 100 is covered by the two plies a and b during the sewing operation for a given trouser leg, three-way valve 206 interrupts the supply of air to the corresponding input of the shuttle valve 204. When the rear tape 100 is exposed after the trailing edge of the seamed trouser leg passes by, the control valve 206 changes state and supplies air to the shuttle valve to trigger the pulse valve 208. Accordingly, a pneumatic impulse is conveyed to the control input of dual output valve 210 which responds by briefly interchanging the connections of the ends of the chopper cylinder 212 so as to vent the lower end of the cylinder and pressurize the upper end to drive the chopper piston down. However, immediately upon cessation of the control impulse, relay 210 resumes normal condition and repressurizes the bottom end of the cylinder and vents the upper end driving the piston back to retract the chopper blade.

If desired, the front guide 30 (FIG. 1) may be altered for automatic changes in spacing of the plates by adding a spring-biased pneumatic cylinder 214 as shown in FIG. 12. A treadle actuated three-way valve 216 is connected to the supply line 186. As shown in normal operation, the treadle is not actuated and the spacing between plates 36, 38 and 40 is preset to accommodate single plies. When bulkier fabric is encountered, for example, it may be desirable to actuate the treadle 218 to temporarily enlarge the spacing between the plates of the front guide 30 to facilitate feeding of the bulkier material.

Figure 15:
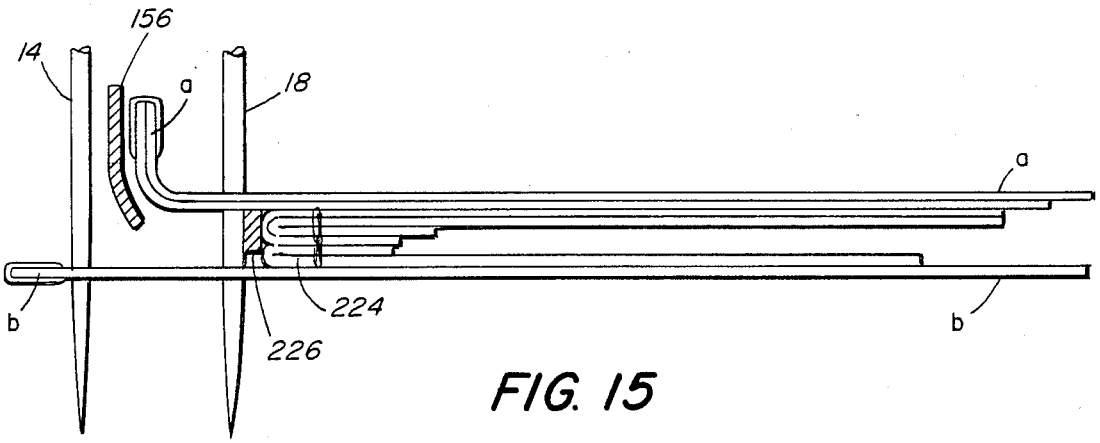
FIG. 15 is a schematic representation of the bottom overedge and join seam needle, viewed from the rear of the machine, with a pocket edge guide.

Pocket edges in men's trousers are frequently placed close to the side seam. It is desirable to prevent the pocket edge from being stitched to the seam. As shown in FIG. 15, the pocket edge 224 is kept away from the seaming needle 18 by means of the pocket edge guide 226. Edge guide 226 can be implemented by forming a depending flange on the left side of the rear end 148*b* of the top guide plate 148 (FIG. 3B) just before and to the left of the needle hole 128. The depending guide 226 must be cantilevered and vertically spaced from the throat plate 16 to leave sufficient room for the lower ply b to freely pass.

An alternative to the front guide 30 (FIG. 1) is shown in FIGS. 16–23. The front right-hand (as viewed in FIG. 10) portion of throat plate 16 is modified by adding a side extension 220 flush with the surface of the throat plate immediately in front of the mounting boss 124. Extension 220 is equipped with two threaded bores 222 and 224. A lower edge guide 226 provides an elongated U-shaped channel member 226*a* to receive and guide the lower ply edge. Slotted mounting tab 228 joined to channel member 226*a* is bolted to the side extension 220 through threaded bore 222. A ply separating flap 226*b* extends leftward from the forward upper edge of the channel member 226*a* approximately coextensive with the front flap 152 of the top guide plate 148. (FIGS. 3A, 3B) The flap 226*b* is axially juxtaposed in front of and aligned in the same plane with the front flap 152 of the top guide plate 148. The forwardmost edge of the front flap 226*b* extends substantially beyond the front edge 16*a* of the throat plate. The lower leading edge 226*c* of the channel member 226*a* is flared downwardly as shown to insure that the edge of the lower ply is caught by the channel member 226*a*.

Figure 16:
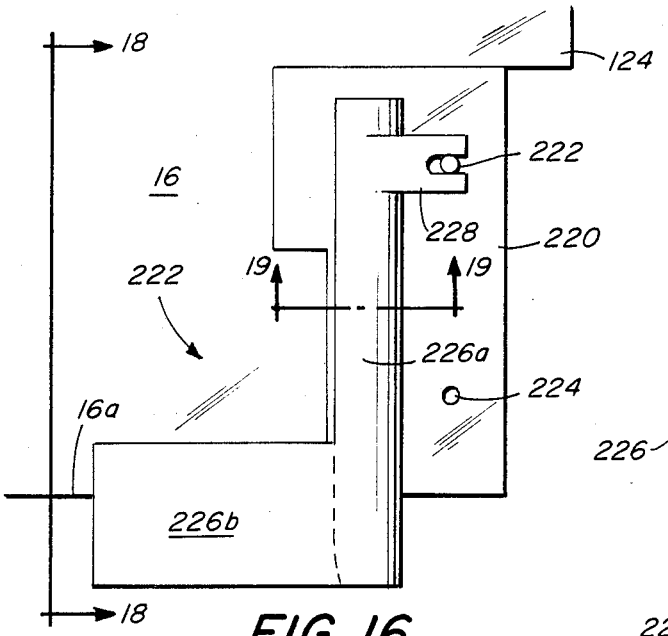
FIG. 16 is a plan view of a portion of an alternate embodiment of the throat plate showing the bottom front edge guide.
Figure 18:
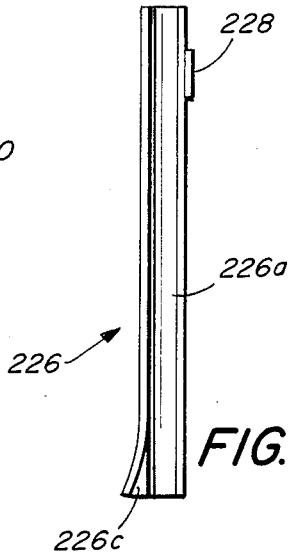
FIG. 18 is a side view of the bottom edge guide taken along lines 18—18 of FIG. 16.
Figure 19:
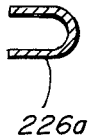
FIG. 19 is a sectional view of the bottom edge guide taken along lines 19—19 of FIG. 16.
Figure 17:
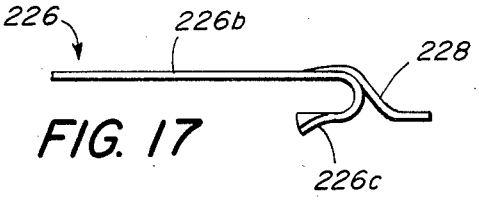
FIG. 17 is a front view of the bottom edge guide of FIG. 16.
Figure 22:
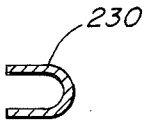
FIG. 22 is a sectional view of the top edge guide taken along lines 22—22 of FIG. 20.
Figure 20:
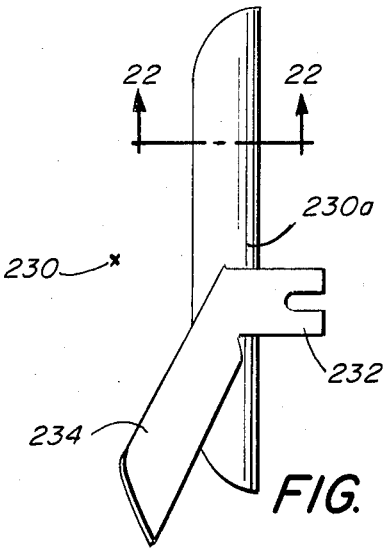
FIG. 20 is a plan view of the top front edge guide for the throat plate of FIG. 16.
Figure 21:
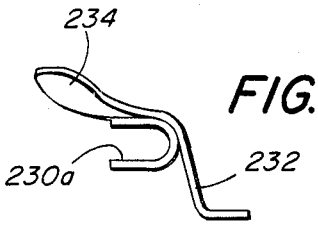
FIG. 21 is a front view of the top edge guide of FIG. 20.

A top edge guide 230 includes a similar channel member 230*a* for receiving and guiding the top ply edge. A slotted mounting tab 232 is joined to the channel member 230*a* and bolted to the throat plate extension 220 through bore 224 (FIG. 16). Upwardly flared front flange 234 is joined to the upper leading edge of the channel member 230*a* to help guide the top ply edge into the channel.

Figure 23:
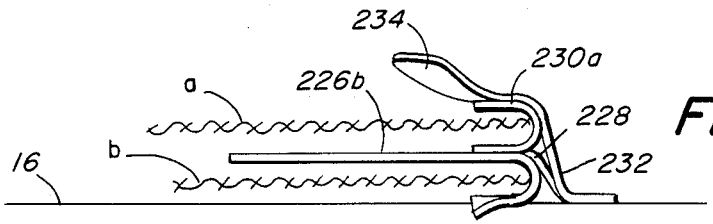
FIG. 23 is a front assembly view of the top and bottom edge guides mounted on the front of the alternate throat plate.

When assembled the top edge guide 230 fits on top of the lower edge guide 226, as shown in FIG. 23, with their channel members 230*a* and 226*a* in substantial alignment. However, the separate slotted mounting tabs for each guide allow individual adjustment to insure perfect edge registration.

Advantages

The double overlock seamer described above incorporates numerous advantages which increase the speed and ease of operation of the automatic double overedge pant seamer to a level never before attained by prior art machinery. In particular, the smoothness of the sewing operation is greatly enhanced by the specially designed top feed dog. Removing the feed dogs that would have been associated with the lower ply alone during overedging of the lower ply eliminates a trouble spot which produced variable feed rates for the upper and lower plies, a particularly great problem where pockets are encountered. Moreover, the tunnel in the top feed dog assists in maintaining the erection of the top ply edge during the seaming and bottom ply overcasting operations.

The responsibility of the presser foot is limited to its conventional role, except for the optional attachment of the guard wall 55. All of the ply separating, diverting and stitch-forming functions are carried out by the throat plate assembly. This not only simplifies the construction of the presser foot and speed and smoothness of operation, but also dramatically increases the visibility in the stitching area. Moreover, the unique design of the top guide plate with twisted stitch tongue followed immediately by the integral curved guide wall 156 makes it nearly impossible for the top ply to become involved in the bottom ply overedging.

When using the guides of FIGS. 16–23, the Rimoldi-type front guide 30 is unnecessary. One advantage of the guides of FIGS. 16–23 is that the work is hand fed much closer to the stitching station with less obstruction.

Finally, the level of automation achieved by the pneumatic circuitry is unprecedented in the prior art twin overedgers. In particular, the automatic end function prevents wasteful thread entanglements by instantly stopping the sewing machine after passage of the trailing edge of the pants leg without operator intervention. The same fiter optic sensor which controls the foregoing operation also disables the presser foot and the top feed dog lift piston while work is being sewn. Likewise, the addition of the chopper to cut thread between pants legs or skirts multiplies the work rate by allowing non-stop automatic operation. The reflective tape and fiber optic implementation of the controls for the pneumatic circuit are unobtrusive and easy to reposition.

Variations

The foregoing description is intended to illustrate a particular embodiment of the invention based on a particular sewing machine adapted specifically for pants seaming. Many variations and modifications can be made without departing from the principles of the invention. For example, a seam may be made by a lock stitch or double chain stitch or some kind of heat seaming operation instead of a chain stitch, a different presser foot may be used, or the curved guide wall 156 may be cantilevered from the side of the throat plate separately from the top guide plate although interconnection between the two is preferred because it prevents the top ply from inadvertently being tucked under the guide wall and interferring with the bottom ply overedging. The flange 160 (FIG. 3B) may be integral with the guide plate 148, and guide elements 144, 148 and 164 can be mounted to the throat plate at separate locations. Curl guide 144 could be integral with the throat plate 16. The lower ply stitch tongue 134 can be dispensed with in some applications. These are, of course, just a few of the possible variations.

Instead of overedging, for applications other than pants, it may be desirable in certain situations to form a different kind of stitch along the edges of the plies. However, the ply diversion technique would still be applicable. Of course, different base units other than the Wilcox Gibbs may be employed with different combinations of stitch forming needles if desired.

A fabric cutting mechanism can be positioned in advance of the stitching station between the cloth guide 30 and the throat plate 60. In many operations, however, the cutter will be unnecessary or even undesirable.

These and other variations and modifications may be made without departing from the spirit and scope of the invention as indicated in the appended claims.

What is claimed is:

1. A sewing machine of the type for producing three distinct lines of stitching in two superposed top and bottom plies in a single sewing operation in which the top ply and bottom ply edges are separately stitched, comprising a base drive mechanism having three spaced juxtaposed, stitch forming means, two of which are in substantial alignment in a stitching area, a throat plate assembly mounted in said stitching area including a base plate having a plurality of feed dog slots, lower feed dog means connected to said drive mechanism for engaging and disengaging the lower surface of the bottom ply through said slots to advance the work through said stitching area, separate presser foot means for urging both plies against said base plate into contact with said lower feed dog means, said throat plate assembly further including means connected to said base plate for diverting one ply while the edge of the other ply is stitched by a corresponding one of said stitch forming means and for diverting the stitched edge of said other ply while the edge of said one ply is stitched by the other one of said aligned stitch forming means, the third one of said stitch forming means being positioned to unite said plies along a seam, whereby said presser foot means is substantially free of active ply diverting elements thus increasing the visibility of the stitching area.

2. The sewing machine of claim 1, further comprising top feed dog means reciprocally mounted after the position of the last stitch forming means above at least one of said feed dog slots in said base plate for advancing the work.

3. The sewing machine of claim 2, wherein said ply diverting means connected to said base plate includes means for folding the lower ply edge out of the way while the edge of said top ply is engaged by a first one of said aligned stitch forming means, means for fully re-extending the lower ply edge, means connected to said base plate for turning the top ply edge upright, curved guide wall means connected to said base plate for maintaining said top ply edge upright as it passes between the second and third stitch forming means, and tunnel means defined through said top feed dog for receiving the upright edge of said top ply.

4. The sewing machine of claim 3, wherein said top feed dog means includes a vertical slot forming said tunnel means and dividing the feed dog means into two sides, one of which acts on two plies and the other of which is superposed above the bottom ply but not in driving contact therewith, whereby the feeding action of the top feed dog means is confined to the two ply side.

5. The sewing machine of claim 4, wherein the portion of the base plate surface beneath the non-feeding one-ply side of the top feed dog means is a substantially continuous surface, whereby, the throat plate assembly has no driving feed dog elements in contact with the single bottom ply adjacent the second stitch forming means.

6. The sewing machine of claim 2, further comprising mechanical means for simultaneously lifting said presser foot and top feed dog means on command, sensor means for disabling said mechanical means when work is present in the stitching area.

7. The sewing machine of claim 6, wherein said sensor means is located at a position corresponding to one of the stitch forming means for producing a control signal indicative of the presence or absence of work.

8. The sewing machine of claim 7, further comprising means responsive to said control signal for disabling said drive means in the absence of work and enabling said mechanical means to lift said presser foot means and top feed dog means, whereby the plies are inserted with the presser foot and top feed dog means up, following which the stitching operation proceeds until it automatically stops after the passage of the trailing edge of the two plies.

9. The sewing machine of claim 1, further comprising a thread chopper blade reciprocally mounted after the last stitch forming means, sensor means at a position corresponding to the last stitch forming means for sensing the passage of the trailing edge of the stitched plies for producing a control signal, mechanical means enabled by said control signal for actuating said chopper blade.

10. The sewing machine of claim 3, further comprising guard wall means connected to said presser foot for keeping the upright top ply edge away from said third stitch forming means.

11. The sewing machine of clalm 1, wherein said throat plate assembly includes at least one mounting boss extending laterally from the side of said base plate away from said work, curl guide means cantilevered from said mounting boss in position to intercept and turn the edge of the lower ply and to collapse it inward, top guide plate means affixed to said mounting boss so as to be cantilevered therefrom at a predetermined height above said base plate, said top guide plate having a front portion for separating said two plies such that the lower ply passes beneath said top guide plate and the top ply passes over said top guide plate, said top guide plate having means after said first stitch forming means for turning up the edge of said top ply and passing it between said second and third stitch forming means.

12. The sewing machine of claim 11, wherein said front portion of said base plate has an axial channel defined in the surface thereof, said top guide plate has depending flange means extending into and along the middle of said channel for drawing a progressively deeper fold of the bottom ply into said channel.

13. The sewing machine of claim 11, further comprising guard wall means connected to said presser foot for keeping the upright top ply edge away from said third stitch forming means.

14. The sewing machine of claim 11, wherein said first and second aligned stitch forming means are overedging means and said third stitch forming means is a join seam stitch forming means, the three stitch forming means collectively defining means for producing a bust open seam.

15. The sewing machine of claim 12, wherein said top guide plate includes a twisted stitch tongue having a base portion onto which the edge of said top ply is bound by said first overedging means, the free end of said twisted stitch tongue being bent upwards so that as the top ply advances, the edge of the top ply is turned up.

16. The sewing machine of claim 15, wherein said top guide plate further includes means after said twisted stitch tongue defining a substantially vertical guide wall juxtaposed with the free end of said stitch tongue for maintaining the upright condition of the top ply edge.

17. The sewing machine of claim 16, wherein the end of said guide wall closer to the free end of the stitch tongue is closely spaced therefrom and positioned on the side away from the work.

18. The sewing machine of claim 17, wherein said top guide plate means further includes a depending flange adjacent to said third stitch forming means and on the side thereof opposite the second overedging means for defining a pocket edge guide to prevent extraneous material from being sewn into the seam.

19. The sewing machine of claim 17, wherein said throat plate assembly further includes cantilevered flange means attached to said base plate for supporting the rear end of said top guide plate carrying said guide wall.

20. A sewing machine of the type for producing three distinct lines of stitching in two superposed top and bottom plies in a single sewing operation in which the top ply and bottom ply edges are separately stitched, comprising a base drive mechanism having three spaced juxtaposed, stitch forming means, two of which are in substantial alignment in a stitching area, a throat plate mounted in said stitching area having a plurality of feed dog slots, lower feed dog means connected to said drive mechanism for engaging and disengaging the lower surface of the bottom ply through said slots to advance the work through said stitching area, presser foot means for urging both plies against said throat plate into contact with said lower feed dog means, means for diverting one ply while the edge of the other ply is stitched by a corresponding one of said stitch forming means and for diverting the stitched edge of said other ply while the edge of said one ply is stitched by the other one of said aligned stitch forming means, the third one of said stitch forming means being positioned to unite said plies along a seam, and top feed dog means reciprocally mounted after the position of the last stitch forming means above one of said feed dog slots in said throat plate for advancing the work.

21. The sewing machine of claim 20, wherein said ply diverting means includes means for folding the lower ply edge out of the way while the edge of said top ply is engaged by a first one of said aligned stitch forming means, means for fully re-extending the lower ply edge, means for turning the top ply edge upright, curved guide wall means for maintaining said top ply edge upright as it passes between the second and third stitch forming means, and tunnel means defined through said top feed dog for receiving the upright edge of said top ply.

22. The sewing machine of claim 21, wherein said top feed dog means includes a vertical slot forming said tunnel means and dividing the feed dog means into two sides, one of which acts on two plies and the other of which is superposed above the bottom ply but not in driving contact therewith, whereby the feeding action of the top feed dog means is confined to the two ply side.

23. The sewing machine of claim 22, wherein the portion of the base plate surface beneath the non-feeding one-ply side of the top feed dog means is a substantially continuous surface, whereby, the throat plate has no driving feed dog elements in contact with the single bottom ply adjacent the second stitch forming means.

24. The sewing machine of claim 20, further comprising mechanical means for simultaneously lifting said presser foot and top feed dog means on command, sensor means for producing a control signal indicative of the presence or absence of work in said stitching area, means responsive to said control signal for disabling said drive means in the absence of work and enabling said mechanical means to lift said presser foot means and top feed dog means, whereby the plies are inserted with the presser foot and top feed dog means up, following which the stitching operation proceeds until it automatically stops after the passage of the trailing edge of the two plies.

* * * * *